US006980106B2

(12) United States Patent
Sutphin

(10) Patent No.: US 6,980,106 B2
(45) Date of Patent: Dec. 27, 2005

(54) REMOTE SENSOR WITH VOICE LOCATOR MESSAGE

(75) Inventor: Eldon M. Sutphin, Merrimack, NH (US)

(73) Assignee: Bae Systems Information and Electronic Systems Integration Inc, Nashua, NH (US)

( * ) Notice: Subject to any disclaimer, the term of this patent is extended or adjusted under 35 U.S.C. 154(b) by 68 days.

(21) Appl. No.: 10/656,460

(22) Filed: Sep. 5, 2003

(65) Prior Publication Data

US 2005/0062605 A1 Mar. 24, 2005

(51) Int. Cl.[7] ..... G08B 1/08; H04Q 7/00

(52) U.S. Cl. ..... 340/539.26; 340/539.22; 340/825.49; 340/825.72

(58) Field of Search ..... 340/539.14, 539.22, 340/539.26, 539.3, 825.49, 5.3, 5.33, 825.69, 340/825.72

(56) References Cited

U.S. PATENT DOCUMENTS 4,821,027 A * 4/1989 Mallory et al. ..... 340/521
5,283,549 A * 2/1994 Mehaffey et al. ..... 340/521
5,349,338 A * 9/1994 Routman et al. ..... 340/692
5,650,800 A 7/1997 Benson
5,959,529 A * 9/1999 Kail, IV ..... 340/539.12
5,990,786 A * 11/1999 Issa et al. ..... 340/429
6,052,052 A * 4/2000 Delmonaco ..... 340/539.11
6,225,901 B1 5/2001 Kail, IV
6,600,424 B1 * 7/2003 Morris ..... 340/628

* cited by examiner

*Primary Examiner*—Daniel Wu
*Assistant Examiner*—Travis R. Hunnings
(74) *Attorney, Agent, or Firm*—Maine & Asmus

(57) ABSTRACT

Techniques that provide relatively low cost and complexity remote sensing capability are disclosed. The sensors can be easily deployed and monitored by a single operator, with minimal opportunity for human error, and without the need for a visual display. During deployment, the sensor is adapted to record a message including a verbal description of the location. Other useful information, such as the operator's name and sensor type may also be included. The voice locator message is transmitted in response to the sensor triggering, thereby allowing the operator to hear the location of the triggered sensor. Additional device functionality may include sensor signal analysis (e.g., confidence testing) and a power conservation. The devices have numerous applications (e.g., military and SWAT operations), and can be adapted to detect intrusion, perimeter breach, movement, vehicles, and other detectable events.

17 Claims, 3 Drawing Sheets

REMOTE SENSOR WITH VOICE LOCATOR MESSAGE

FIELD OF THE INVENTION

The invention relates to sensor technology, and more particularly, to a remote sensor configured with a voice locator message.

BACKGROUND OF THE INVENTION

Sensors can generally be employed to detect when a particular event occurs. For instance, sensors can be used to detect when a target pressure, temperature, or sound occurs. Some sensors can detect proximity to an object or person. Other sensors can detect speed or the location of an object. Such sensors can be implemented in a number of technologies, including infrared, radar, and seismic technologies. Some sensors can be implemented with a combination of such technologies (e.g., infrared proximity and seismic sensors).

Remote sensors have numerous applications in both the military and commercial arenas. Such applications include detecting intrusion into a secure room or facility, personnel movement, vehicle speed, and perimeter breach of a field position. Typically, remote sensors are deployed in an area to be monitored. The location of each sensor is noted. The deployed sensors are communicatively coupled to a remote collection site where transmitted sensor signals can be interpreted. In this way, when the area being monitored experiences activity, that activity can be detected and appropriate action can be taken.

Correctly noting the location of each deployed sensor is essential. Otherwise, interpreting the sensor signals received at the remote location will be difficult if not impossible, particularly where a large number of sensors are deployed over a large area. Consider, for example, the case where ten or more sensors are deployed on several floors of a multi-story building having multiple entrances/exits. Transmissions from each sensor must be associated with a particular location within the building for the data to have specific meaning (e.g., how many personnel on each floor, how many personnel have entered/exited a particular floor).

Noting the location of each sensor is not a trivial task. If a reasonable number of sensors are deployed, their respective locations can be maintained in the memory of the person who deployed them. Another technique is to program the location of each sensor into a central computer database (e.g., PDA or base station). Activity detected by the sensors included in the database can be indicated via a graphical user interface or other display that shows sensor locations. Such sensor location methods are associated with a number of problems.

For instance, there are clear difficulties associated with an individual attempting to remember the location of multiple sensors. Faulty memory and stressful conditions under which total recall is required render this manual technique impractical for many applications. Moreover, each sensor typically transmits on a unique channel or path, so that one sensor output can be distinguished from another. As such, substantial communication bandwidth may be required. To accommodate the unique transmission scheme, each sensor must have a unique transmitter configuration, thereby increasing manufacturing complexity and cost.

With respect to sensor database techniques, entering sensor location information into a computer or similar device requires not only data entry (which is time consuming and prone to human error), but also requires the user to carry that input device. This added baggage is in addition to the sensors for deployment and any other necessary equipment (e.g., weapon, munitions, 2-way radio) that must be carried by the user. Although the data entry burden can be reduced with customized in-intake algorithms and user-friendly graphical user interfaces, such techniques add complexity and cost to the overall design of the remote sensor system. Other techniques that further automate the deployment process so as to reduce the problems associated data entry add further complexity and cost, and are more difficult to use.

What is needed, therefore, are low cost and complexity remote sensing techniques where sensors can be easily deployed and monitored, with minimal opportunity for human error.

BRIEF SUMMARY OF THE INVENTION

One embodiment of the present invention provides a remote sensor device including a sensor module that is adapted to sense one or more event types, a storage module that is adapted to store a voice message including a deployment location description of the device, and a transmitter that is adapted to wirelessly transmit the voice message in response to the sensor being triggered. The device can be deployed by an operator, where the voice message further includes the operator's name. The sensor module may employ, for example, at least one of IR, acoustic, radar, electro-static, and seismic sensing capability.

The device may further include a processor that is operatively coupled to the transmitter and the storage module, and that is adapted to control operation of the device. In one such embodiment, the processor can command the transmitter to transmit in analog and digital. The processor may further be adapted to carry out a power conservation mode where power consuming components of the device are commanded to a sleep or low power mode during periods of inactivity. The processor may be further adapted to command transmission of a pre-stored message indicative of the confidence level.

The device may further include a microphone that is operatively coupled to an amplifier, thereby enabling voice messages to be captured and converted into an electronic signal. A switch can be operatively coupled to the processor, and adapted to enable a voice message recording session. The microphone that is operatively coupled to the amplifier may also be used to enable real-time ambient sound to be captured and converted into an electronic signal. Here, the transmitter can be further adapted to wirelessly transmit the electronic signal. The device may further include a digitizer that is adapted to receive a captured voice message and to convert it to a digital signal for storage in the storage module.

The device may further include a processor that is adapted to determine a confidence level associated with a sensor signal provided by the sensor module. The sensor signal can be compared, for example, to a pre-defined reference (e.g., threshold signal) to determine its confidence level. In response to the sensor signal having an acceptable confidence level, the processor can be further adapted to command transmission of the stored voice message in analog, digital, or both using the transmitter.

Another embodiment of the present invention provides a method for remotely sensing an event. In response to no sensor being triggered, the method includes continuing monitoring for at least a set period of time (e.g., continuously or according to a pre-set time schedule). In response to determining that a sensor has been triggered, the method includes transmitting a recorded message including a verbal description of the sensor location.

In one particular embodiment, the method has a set-up mode that includes receiving an activation signal to initiate the set-up mode, enabling a voice message recording session, and recording the message including the verbal description of the sensor location. An operator may initiate the set-up mode, and the verbal message may further includes the operator's name. In response to the sensor triggering, the sensor outputs a sensor signal, and the method may further include transmitting one or more pre-recorded messages indicative of a confidence level associated with the sensor signal. The method may further include transmitting real-time sound from the area for a period of time relative to a sensed event (e.g., while the event is being sensed and or the period immediately following the sensed event).

Another embodiment of the present invention provides a method for remotely sensing an event with a sensor configured with a voice locator message. The method includes identifying a location to be monitored, and enabling a sensor voice recording session. The method then continues with announcing at least one of operator name and sensor location, thereby creating a recorded voice message for transmission when the sensor triggers. A number of sensors may be deployed in an area, and each sensor can transmit on a common channel. In such a case, the method may further include tuning a remote receiver to the common channel, thereby enabling a communication link between the remote receiver and the area.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION OF THE INVENTION

Figure 1:
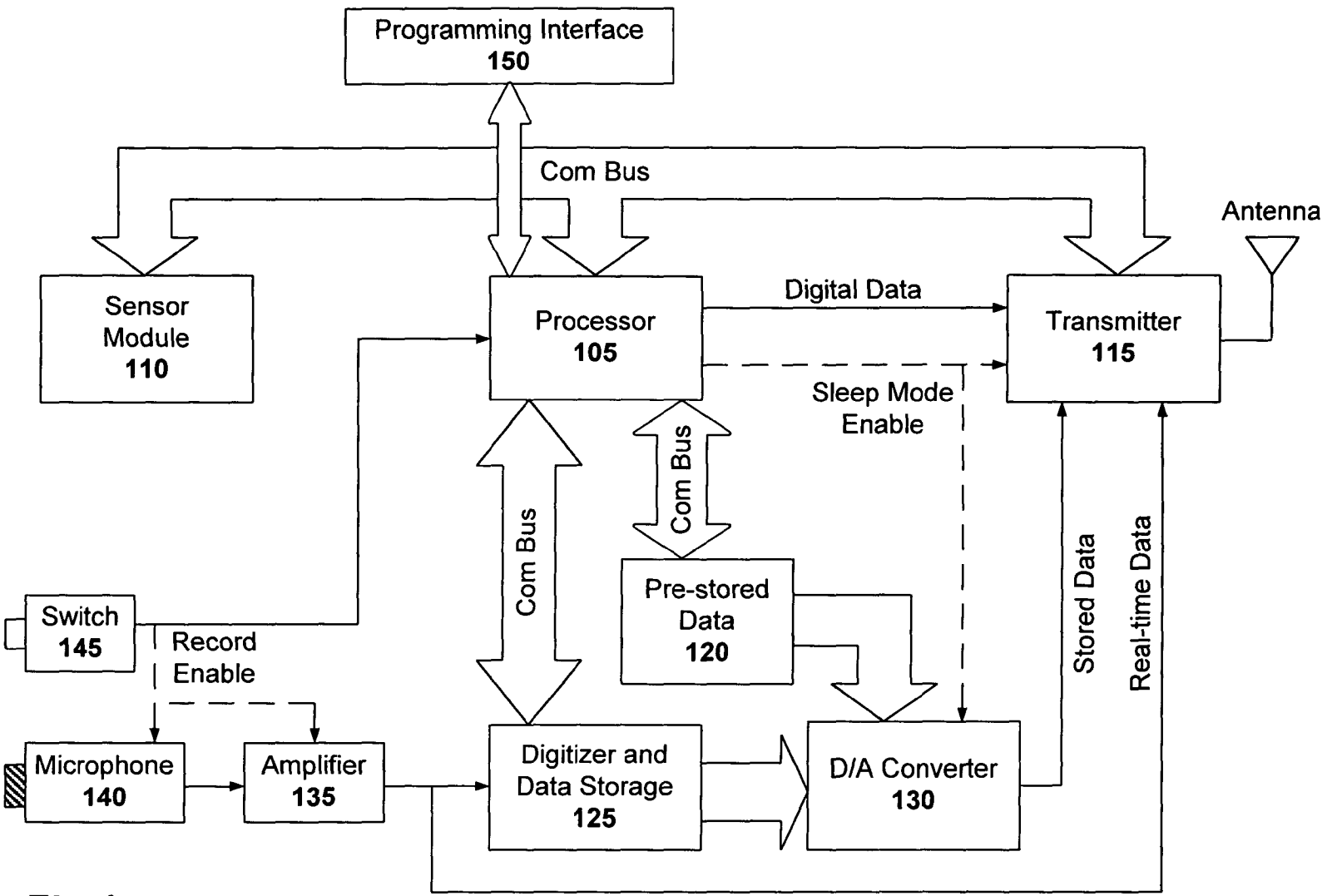
FIG. 1 is a block diagram of a remote sensor configured in accordance with one embodiment of the present invention.

Embodiments of the present invention provide relatively low cost and complexity remote sensing capability. The disclosed sensors are compact and can be easily deployed and monitored by a single operator, with minimal opportunity for human error, and without the need for a visual display. The remote sensing devices can be adapted to detect intrusion, perimeter breach, movement, vehicles, and other detectable events. The disclosed techniques can be employed in numerous applications, as might be used in military or SWAT operations.

In operation, an operator (e.g., such as a sniper or someone clearing a building) could carry several of the remote sensors along with a single pocket size receiver and earphone used for monitoring the sensors. An existing radio net (military or commercial) can also be used as a link between the sensors and the receiver. When a sensor is deployed, the operator activates its recording function to record a short message including the location of the sensor. The operator can also record his name to further distinguish his sensors from other operators using the same receiver channel. Thus, when multiple sensors are used, the operator is alerted by his own name and voice (e.g., via an RF link) to the occurrence of an event at the announced location. For instance, the operator can record, "Eldon: $1^{st}$ floor, east wall door." This is the message that will be heard by the operator in response to the sensor triggering, thereby remotely indicating activity at the east wall door of the first floor. Upon hearing this message, the operator can take appropriate action (e.g., converge on the $1^{st}$ floor east wall door, or exit via $2^{nd}$ floor west wall fire escape).

The sensors can use a common transmit frequency, so that the operator only has to monitor a single channel for all deployed sensors. Thus, the use of multiple receivers or having to scan multiple channels is avoided. This is possible because the recorded messages are relatively short, and each transmitted message can be associated with a specific operator. After all the sensors are deployed, the radio receiver is tuned to the sensor frequency and the monitoring begins. Operators can distinguish their sensors from those sensors of others by the sound of their own voice (and name, if recorded). During a triggering event, the sensors broadcast their short messages over the common channel. Optional pre-recorded voice messages or tones can also be transmitted to give the operator an audible indication of the strength or confidence level of the alert, based on analysis performed by the sensor. Multiple sensing elements such as infrared (IR), radar, electro-static or e-field, and seismic sensing elements, may be contained in the same sensor, including a microphone for optionally providing an acoustic sensor that can broadcast a few seconds of the ambient sound (i.e., local to the sensor) during an alert or used as a sound level sensor. The system can report analog and/or digital data (compressed or non-compressed), depending on the type of receiving equipment.

Remote Sensor Architecture

FIG. 1 is a block diagram of a remote sensor configured in accordance with one embodiment of the present invention. As can be seen, the system includes a processor 105, a sensor module 110, a transmitter 115, a pre-stored data module 120, a digitizer and storage 125, a digital-to-analog (D/A) converter 130, an amplifier 135, a microphone 140, a switch 145, and a programming interface 150. The remote sensor includes a number of operating modes including: program mode, set-up mode, and monitor mode. The sensor may also include a number of power modes, such as power down mode, sleep mode, and full-on mode. Each of the components 110 through 150 can be implemented in conventional technology, and numerous variations and embodiments will be apparent in light of this disclosure.

The processor 105 is programmed and/or otherwise configured to effect the principles of the present invention. In one particular embodiment, the processor 105 is implemented with a micro-controller unit configured with a central processing unit (e.g., for executing programs and providing overall sensor control), memory (e.g., for storing programs and control parameters), I/O capability (e.g., for receiving input from switch 145, and providing communication buses to other sensor componentry and the programming interface), and a number or executable processes for carrying out various sensor functions, depending on the mode of operation. Alternatively, the processor 105 can be implemented as a custom built semiconductor (e.g., FPGA or ASIC). Likewise, the entire sensor can be so implemented, to provide a single discrete module, having a high degree of manufacturability.

In the programming mode, the processor 105 can be accessed and programmed (e.g., via an operation center or other host) by the programming interface 150. Thus, control parameters and functionality of sensor can be defined, such as the transmission parameters (e.g., channel frequency and coding scheme) employed by transmitter 115. Likewise, function specific executable modules can be downloaded to the processor 105, such as sensor data analysis and confidence testing algorithms. Diagnostic testing may also be performed via the programming interface. Alternatively, executable diagnostic testing modules can be downloaded to the controller 105, thereby enabling self-contained diagnostic capability. The programming mode can be carried out either in the field or pre-deployment, as long as a host is available.

In the set-up mode, an operator selects a desired location for deploying the sensor. Switch 145 is then used to activate the recording function of the sensor. In this particular embodiment, the recording is carried out by microphone 140, amplifier 135, and digitizer/storage 125. Switch 145 can be, for example, a push button switch, toggle, or a voice activated switch. Note that switch 145 can also be used to enable microphone 140 and amplifier 135, thereby allowing those devices to maintain a dormant state when recording is not being conducted. A similar record enable signal can be provided from the sensor module 110.

With the recording function activated in response to activation of switch 145, the operator speaks the desired sensor location into the microphone 140. Other helpful information may be recorded as well, such as the operator's name. The switch 145 is then released or otherwise deactivated. The microphone 140 converts the operators voice message into an electrical signal, which is amplified by the amplifier 135. The amplified signal is then converted to its digital equivalent with analog-to-digital (A/D) conversion of module 125 and stored therein. Note that the storage facility may alternatively be separate from the digitizer module 125. In any event, the operator's voice message is recorded and stored.

Processor 105 communicates with the digitizer/storage module 125 via a communications bus, and can provide control parameters and supplemental processing that support the recording function. For example, sampling rates and converter resolution can be provided from processor 105 to the A/D converter of module 125. Likewise, a dithering signal (e.g., thermal noise) can be provided to improve the quality of the A/D conversion. Once the A/D conversion is complete, the digital data can be provided from the module 125 to the processor 105, where a data compression algorithm can be performed. The compressed result can then be provided back to module 125 for storage. The set-up mode can be performed in the field, or pre-deployment, assuming prior knowledge of the area to be monitored.

Note that information other than name and location may be recorded as well, such as the sensor type (e.g., "IR" or "vibration"). Such information is particularly helpful where multiple sensor types are deployed, as it may further characterize an event that has occurred. For instance, an IR sensor indicates proximity, while a seismic sensor indicates both proximity and physical disturbance of the location. If both sensor types trigger, then it is reasonable to assume a positive activity (e.g., personnel or vehicles entering area). If only the IR sensor is triggered, however, then it is reasonable to assume that the thing being sensed has low mass or is otherwise not generating and detectable vibrations (e.g., flying bird or small animal).

In the monitor mode, the sensor "listens" for activity in its location. The monitoring can be continuous (e.g., until the power source of the sensor is depleted). Alternatively, the monitor mode can be enabled pursuant to a programmed schedule (e.g., listen from 6 am to 9 am, and from 5 pm to 12 am). Sensor module 110 operates to detect various events, depending on the type or types of sensors used. Any number of sensor technologies can be employed in this module, with acoustic, IR, radar, electro-static, e-field, electrometer, seismic, temperature, and pressure to name a few. Any sensing technology can be used here.

When an event is sensed, sensor 110 provides an electrical signal to the processor 105 via a communication bus. The processor 105 may be configured to analyze the strength or confidence level of the sensor signal. For example, the sensor signal can be compared to a threshold signal or pre-stored "model" data from module 120. If the sensor signal is deemed inferior based on the comparison, then the sensor signal can be classified as a low confidence signal and/or ignored. Otherwise, the processor 105 commands module 125 to output the stored message (e.g., operator name and sensor location) to converter 130. The analog equivalent of the message is then used to modulate the transmitter 115, which wirelessly transmits the message to a remote receiver, thereby conveying to the operator in his own voice the location of the sensor.

In an alternative embodiment, the processor 105 causes all sensor signals to be transmitted. If sensor signal analysis is performed and resulted in the likes of a low confidence rating, then additional messages pre-stored in module 120 representing that confidence level can optionally be transmitted as well. For example, the signal analysis can compare the signal strength of the sensor signal to a look-up table of sensor signal strengths indexed by a confidence rating (e.g., scale of 1 to 10, with 1 being low confidence and 10 being high). The confidence rating of the signal strength closest in value to the strength of the sensor signal is then selected, and a previously recorded message of that confidence rating can be transmitted as well. Thus, an example transmission might produce the following report: "Eldon; $1^{st}$ floor, back door; 8." This report indicates that the sensor on the first floor back door has triggered, and the resulting sensor signal has a confidence rating of eight.

The transmitted "report" can also include other information, such as sensor status. This type of information can be transmitted periodically or only when necessary. For example, processor 105 can be adapted to monitor the sensor power source (e.g., battery), and to associate the actual power with a pre-recorded voice message indicative of the power. If the power level is approaching a low level, then the corresponding voice message can be transmitted. This message could be sent on its own, or included with other messages. An example report might be: "power at 5%, 1 hour remaining." Thus, the operator would know not to rely on the deployed sensor much beyond an hour. It will be appreciated the actual reported messages can take on many forms, coding, and level of detail.

Note that the remote sensor may be configured to report real-time data detected at the remote location. In this particular embodiment, microphone 140 amplifies ambient sound while sensor 110 is active. The detected sounds are amplified by amplifier 135, and then used to modulate the transmitter 115, which wirelessly transmits the detected sounds to the remote receiver. The detected sound can be transmitted, for instance, after the corresponding alert message is transmitted. Thus, the operator is not only alerted to an event sensed by the sensor module 110, he is also given an opportunity to remotely listen to conversations and other sounds taking place at the location during the event. In such an embodiment, note that sensor 110 can also be used to enable the microphone 140 and amplifier 135 to allow for real-time listening (for applications where microphone 140 and amplifier 135 are only powered-up/enabled in response to a detected event as indicated by sensor 110).

As can be seen, the processor 105 can further be configured to output a digital message/report to the transmitter 115, and can therefore be used to communicate with systems having a more sophisticated digital-based interface. Note that the digital transmission can include compressed data stored in module 125. Further note that the digital transmission can include real-time data or stored data. The processor 105 also controls the transmitter 115, the characteristics of which can be set via the programming interface 150 as previously explained. Thus, processor 105 can set the transmission parameters, such as transmission mode (e.g., digital or analog), channel frequency, and coding schemes employed by transmitter 115.

Further note that processor 105 can be configured to carry out a power conservation algorithm. In more detail, once the sensor is deployed, only certain components need to be fully powered until an event is detected. For example, the sensor 110 and processor 105 are generally awake at all times to ensure detection of an event of interest (assuming a monitoring time schedule is not desired). Once an event is detected, the processor 105 can be configured to send out wake-up signals to each involved component. In the embodiment shown in FIG. 1, the transmitter 115 and the D/A converter 130 are disabled (e.g., via the sleep mode enable control line) during quiet periods, thereby preserving a significant amount of power that might otherwise be consumed by these devices. In response to receiving indication of a sensed event, the processor 105 issues a control output to the transmitter 115 and the D/A converter 130, so that they become fully operational. Other power conservation techniques and schemes will be apparent in light of this disclosure.

Numerous variations on the sensor architecture and configuration are possible in light of this disclosure, and the present invention is not intended to be limited to any one such embodiment. For example, the functionality of processor 105, digitizer/storage module 125, and the D/A converter 130 can be integrated into a single module (e.g., microcontroller). Likewise, the pre-stored data module 120 can be included in the storage of module 125. Also, the remote sensor may be configured to operate in different environments, such as underwater (e.g., using acoustic and pressure sensors and a sonar transmitter). Also, the transmitter 115 can be configured as a transceiver that allows the sensor to receive communications. Such receiving capability could provide an alternative to the programming interface 150. The particulars of any one configuration will be driven by factors such as the given application, desired implementation costs and manufacturability, desired transmission range, desired battery-life, complexity of the on-board processing and control, and the overall desired performance.

Methodology

Figure 2:
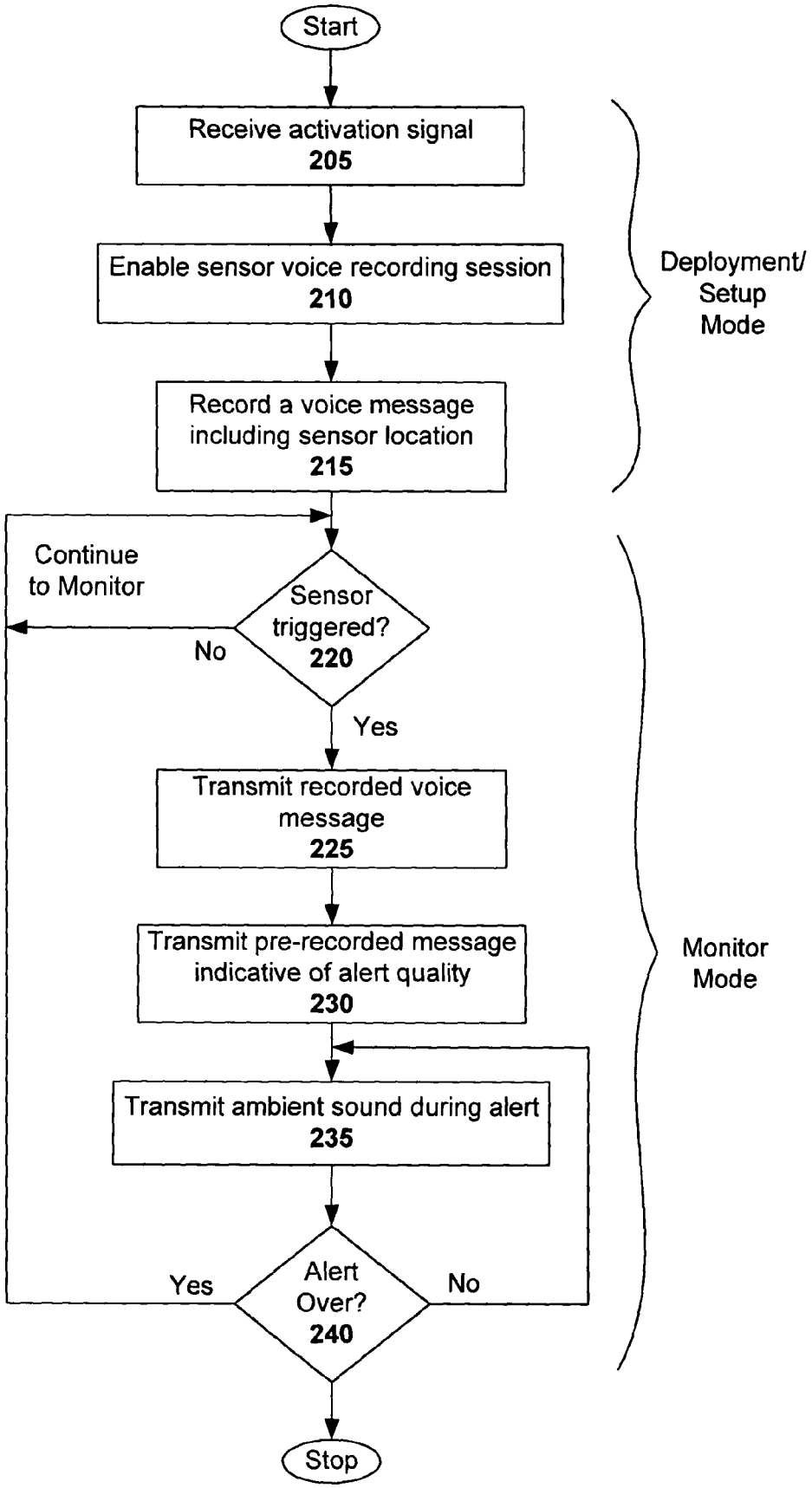
FIGS. 2 and 3 are each a flow chart illustrating a method for remotely sensing an event in accordance with an embodiment of the present invention.

FIG. 2 illustrates a method for remotely sensing an event in accordance with an embodiment of the present invention. The method can be carried out or otherwise controlled by, for example, the processor 105 of the sensor shown in FIG. 1. As can be seen, the method includes a deployment or set-up mode and a monitor mode. Other modes of operation, such as the programming mode or power conservation mode, are also possible as previously discussed.

The setup mode of the method begins with receiving 205 an activation signal, such as that provided by a manual or voice activated switch that is activated by an operator. The method proceeds with enabling 210 a voice recording session (e.g., via a microphone, amplifier, and A/D converter). Note that the activation signal itself may be what enables the voice recording session. Alternatively, the activation signal may be received by a processor, which then operates to enable the recording session.

In any event, the setup mode of the method continues with recording 215 a voice message including the location of the sensor. As previously explained, the message may include other information as well, such as the operator's name. Other distinguishing and or useful information may also be recorded.

The monitor mode of the method includes determining 220 if the deployed sensor has been triggered. If not, then the sensor continues monitoring. If the sensor is triggered, then the method proceeds with transmitting 225 the recorded voice message (e.g., name and sensor location data). In addition, the method may further include transmitting 230 one or more pre-recorded messages indicative of alert quality, sensor status, and other information pertinent to the sensor and its reported data. The method may also include transmitting 235 ambient sound during or just after an alert. This real-time data reporting can be carried out as previously explained, using a microphone, amplifier, and transmitter that are triggered to report when the sensor is active. This real-time reporting can be carried out using digital or analog transmissions.

The method may further include determining 240 if the alert is over. If not, the method can continue with transmitting of the real-time ambient sound. If the alert is over, then the transmitting of the real-time ambient sound is stopped, and the method continues in the monitor mode for the next alert. Alternatively, the real-time reporting can be enabled for a set period (e.g., 30 seconds) of time after a trigger event. After the set period of time, the processor can disable the real-time listening. Here, the trigger event can stop, but the real-time reporting continues.

Variations on the method are possible. In one such embodiment, a timer can be set to limit looping activity. For example, a maximum time limit can be set for the looping between the determination at 240 and the transmitting at 235. Similarly, if the looping performed at determination 220 continues for a pre-set time with no trigger event, then a power conservation mode can be enabled as previously explained (e.g., command the transmitter or other power consuming componentry to a sleep or low-power mode). Also, the method may be configured with a maximum deployment time parameter as measured by a master clock, where once the clock runs out, a self-destruction routine (e.g., explosive or chemical breakdown) is enabled.

Figure 3:
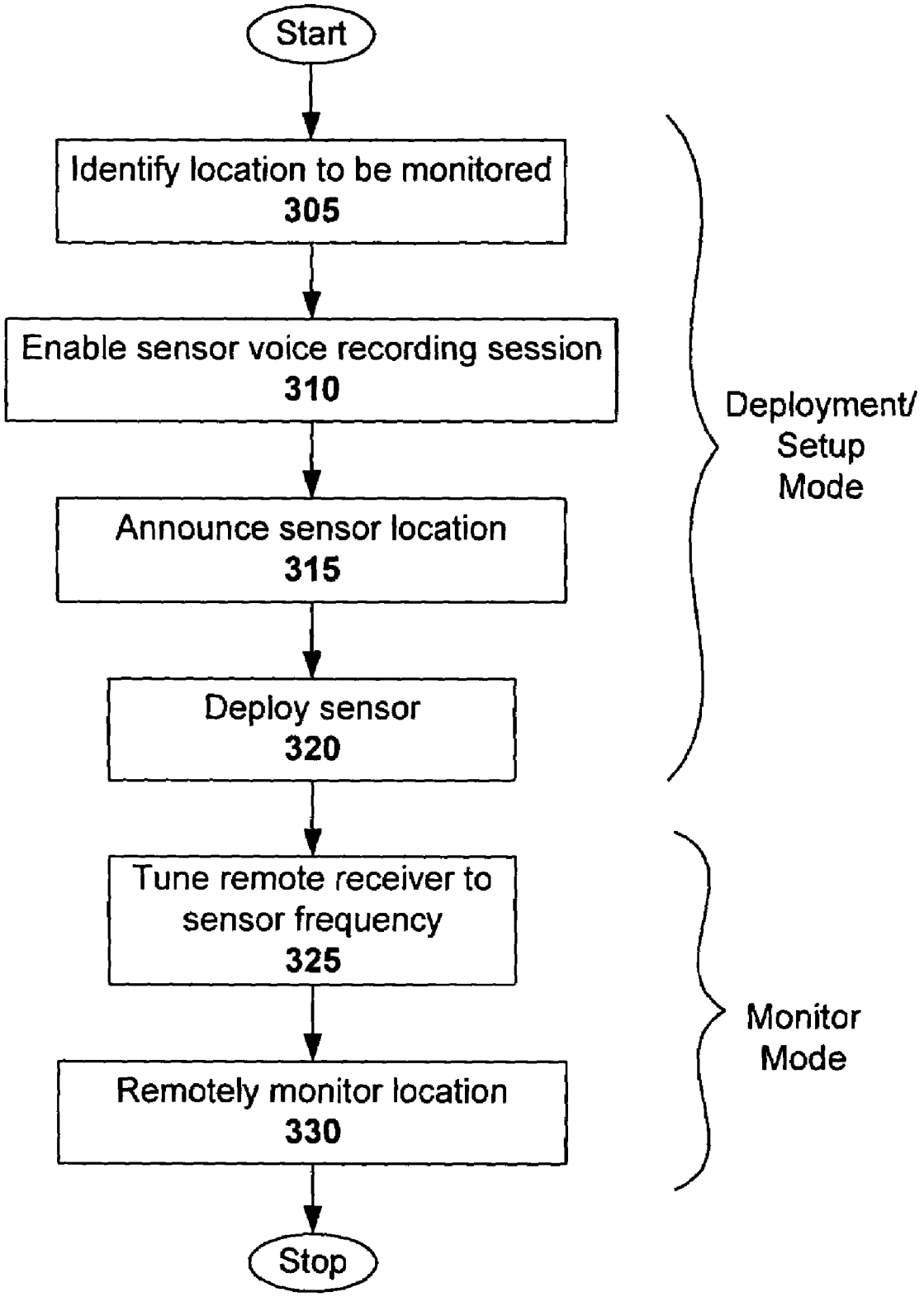

FIG. 3 illustrates another method for remotely sensing an event in accordance with an embodiment of the present invention. This particular method can be carried out by an operator, and includes a set-up mode and a monitor mode. Just as with the method of FIG. 2, other modes of operation are also possible here.

The method begins with identifying 305 a location to be monitored. Depending on the particular application, the location could be outside (e.g., perimeter of wooded area), in a building or other structure, in a vehicle (e.g., car, airplane, ship, train), or under water (e.g., monitor underwater in-take port of power plant).

Regardless of the location, the method continues with enabling 310 a sensor voice recording session, and announcing 315 sensor location. Recall that other distinctive messages may be stored here as well, such as operator name. Once the message is recorded, the method continues with deploying 320 the sensor. For example, the sensor may include a sticky pad or other adhesive surface that can be exposed and fastened to a surface in the target area. Alternatively, the sensor can simply be selectively placed somewhere in the area.

In the monitor mode, the method continues with tuning 325 a remote receiver to the sensor frequency. Note the receiver can be attached to the operator and communicatively coupled to an ear piece that can be worn by the user for discreet and hands-free listening. As previously indicated, the range between the receiver and the sensor device can vary depending on the application. In one particular embodiment, the range is about 100 to 300 yards. It will be appreciated that the longer the range, the greater the transmit power and size of the sensor device. The method then proceeds with remotely monitoring 330 the location, which may simply include listening to reported events and or taking appropriate action dictated by a particular report.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A remote sensor device comprising:

a sensor module adapted to sense one or more event types, said sensor module employs at least one of the group consisting of IR, acoustic, radar, electro-static, and seismic sensing capability;

a storage module adapted to store a voice message including a deployment location description of the device wherein the device is deployed by an operator, and the voice message further includes the operator's name; and a transmitter adapted to wirelessly transmit the voice message in response to the sensor being triggered.

2. The device of claim 1 further comprising:

a processor operatively coupled to the transmitter and the storage module, and adapted to control operation of the device.

3. The device of claim 2 wherein the processor can command the transmitter to transmit in analog and digital.

4. The device of claim 2 wherein the processor is further adapted to carry out a power conservation mode where one or more power consuming components of the device are commanded to a sleep or low power mode during periods of inactivity.

5. The device of claim 2 further comprising:

a microphone operatively coupled to an amplifier thereby enabling the voice message to be captured and converted into an electronic signal; and a switch operatively coupled to the processor, and adapted to enable a voice message recording session.

6. The device of claim 1 further comprising:

a microphone operatively coupled to an amplifier thereby enabling real-time ambient sound to be captured and converted into an electronic signal;

wherein the transmitter is further adapted to wirelessly transmit the electronic signal.

7. The device of claim 1 further comprising:

a digitizer adapted to receive a captured voice message and to convert it to a digital signal for storage in the storage module.

8. The device of claim 1 further comprising:

a processor that is adapted to determine a confidence level associated with a sensor signal provided by the sensor module.

9. The device of claim 8 wherein the sensor signal is compared to pre-defined reference to determine its confidence level.

10. The device of claim 8 wherein in response to the sensor signal having an acceptable confidence level, the processor is further adapted to command transmission of the stored voice message in at least one of analog or digital using the transmitter.

11. The device of claim 8 wherein the processor is further adapted to command transmission of a pre-stored message indicative of the confidence level.

12. A method for remotely sensing an event, the method comprising:

in response to no sensor being triggered, continuing monitoring for at least a set period of time; and in response to determining that a sensor has been triggered, transmitting a recorded message including a verbal description of the sensor location, and including an operator's name that deployed said sensor.

13. The method of claim 12 wherein the method includes a set-up mode comprising:

receiving an activation signal to initiate the set-up mode;

enabling a voice message recording session; and recording the message including the verbal description of the sensor location.

14. The method of claim 12 wherein in response to the sensor triggering, the sensor outputs a sensor signal, the method further comprising:

transmitting one or more pre-recorded messages indicative of a confidence level associated with the sensor signal.

15. The method of claim 12 further comprising;

transmitting real-time sound from the area for a period of time relative to a sensed event.

16. A method for remotely sensing an event with a sensor configured with a voice locator message, the method comprising:

identifying a location to be monitored; deploying at least one sensor in said location by at least one operator;

enabling a sensor voice recording session;

announcing at least an operator name and a sensor location, thereby creating a recorded voice message for transmission when the sensor triggers; and responding to said event by said operator located in said location.

17. The method of claim 16 wherein a number of sensors are deployed in an area, and each sensor transmits on a common channel, the method further comprising:

tuning a remote receiver to the common channel, thereby enabling a communication link between the remote receiver and the area.

* * * * *